US011661816B2

(12) United States Patent
Alshalan et al.

(10) Patent No.: US 11,661,816 B2
(45) Date of Patent: May 30, 2023

(54) METHOD AND APPARATUS FOR CEMENTING A CASING IN A WELLBORE

(71) Applicant: SAUDI ARABIAN OIL COMPANY, Dhahran (SA)

(72) Inventors: Meshari M. Alshalan, Dhahran (SA); Amjad Alshaarawi, Khobar (SA); Abdulwahab Aljohar, Dhahran (SA); Haytham H. Alhamed, Al Khubar (SA); Mohammed M. Alrubaii, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/874,773

(22) Filed: May 15, 2020

(65) Prior Publication Data

US 2021/0355783 A1 Nov. 18, 2021

(51) Int. Cl.
*E21B 33/16* (2006.01)

(52) U.S. Cl.
CPC ..... *E21B 33/16* (2013.01)

(58) Field of Classification Search
CPC ..... E21B 33/16
USPC ..... 166/285
See application file for complete search history.

(56) References Cited

U.S. PATENT DOCUMENTS 3,119,451 A * 1/1964 Hall ..... E21B 33/136 166/241.7
4,491,178 A * 1/1985 Terrell ..... E21B 33/134 166/285
5,115,860 A * 5/1992 Champeaux ..... E21B 43/08 166/278
8,342,243 B2 * 1/2013 Esmail ..... E21B 33/136 166/285
9,038,720 B2 * 5/2015 Esmail ..... E21B 33/146 166/285

FOREIGN PATENT DOCUMENTS

WO 2008/069914 A2 6/2008

OTHER PUBLICATIONS

Rickard, William et al., "Top Squeeze or Top Fill: Improved Secondary Cementing for Geothermal Wells", Proceedings of the 4th African Rift Geothermal Conference, Nairobi, Kenya, Nov. 2012 (4 pages).

(Continued)

*Primary Examiner* — William D Hutton, Jr.
*Assistant Examiner* — Ashish K Varma
(74) *Attorney, Agent, or Firm* — Osha Bergman Watanabe & Burton LLP

(57) ABSTRACT

A method of cementing a casing in a wellbore extending from an Earth's surface into a subsurface includes providing a tube having a bi-frustoconical shape. The bi-frustoconical shape is defined by an upper tube part having an inverted frustoconical shape, a lower tube part having a frustoconical shape, and a waist intermediate between the upper tube part and the lower tube part. The tube is positioned in an annulus formed between the casing and a wall of the wellbore from a surface opening of the annulus. The tube is urged in a direction down the annulus and along the casing until the tube lands on a collar radially projecting from an outer surface of the casing into the annulus.

19 Claims, 7 Drawing Sheets

(56) References Cited

OTHER PUBLICATIONS

Saito, Seiji, "A New Advanced Method for Top-Job Casing Cementing", Journal of the Geothermal Research Society of Japan, vol. 17, No. 1, 1995, pp. 33-42 (16 pages).
International Search Report and Written Opinion issued in corresponding International Patent Application No. PCT/US2020/033763, dated Jan. 20, 2021 (13 pages).

* cited by examiner

METHOD AND APPARATUS FOR CEMENTING A CASING IN A WELLBORE

FIELD

The disclosure relates generally to completion of wellbores, for example, for hydrocarbon production and more particularly to cementing of casings in wellbores.

BACKGROUND

When drilling a wellbore through subsurface formations to produce hydrocarbons, it is common practice to protect the wellbore with one or more casings. The first casing installed in a wellbore is called a conductor casing (or conductor pipe). The conductor casing typically prevents drilling fluids from circulating outside the wellbore and causing surface erosion. The conductor casing is usually no more than 20 to 50 feet long. The next casing installed after a conductor casing is a surface casing, which typically prevents hydrocarbons from encroaching into fresh water zones. Surface casing may also be used to anchor blowout preventers. Surface casing may extend several thousand feet into the subsurface. In some wells, intermediate casing may be installed in the wellbore after the surface casing. Intermediate casing may be used to protect against weak or abnormally pressured formations. The final casing installed in the wellbore is a production casing. Each of these casings extends from the surface to a depth in the wellbore and protects a certain section of the wellbore. Each casing is typically made of casing sections or joints that are screwed together to form a desired length of casing. Typically, the screwing together of the casing joints occurs as the casing is lowered into the wellbore. The first joint of a casing run into the well typically has a guide shoe, which is a short heavy cylindrical section filled with concrete and rounded at the bottom. The guide shoe prevents the casing from hitting rock ledges or washouts in the wellbore as the casing is lowered. The casing joints may also carry centralizers that assist in centering the casing in the wellbore.

Casings are typically bonded to the wellbore and other casings by cement. The process for cementing a casing in a wellbore typically includes pumping cement slurry down the interior of the casing and allowing the cement slurry to flow out of the bottom of the casing, around the guide shoe, and into an annulus outside of and surrounding the casing. The wellbore is then shut in to allow the cement slurry in the annulus to set or harden. Some wells require complete cementing of the casing, where the cement in the annulus extends from the bottom of the casing to the surface. In these cement jobs, cement slurry is pumped through the casing and into the annulus outside of the casing until cement return from the annulus is observed at the surface, indicating that the annulus has been filled with cement. However, there are instances where cement return is initially observed at the surface, followed by a drop in the column of cement in the annulus. This may occur if the bottom of the casing is set above a lost circulation zone (i.e., a formation zone that steals fluids from the wellbore) so that the cement slurry that should fill the annulus is sucked into the formation, which leaves the area above the lost circulation zone unprotected. In cases where the top of the cement is below the surface, a "top job" (i.e., filling the annulus with cement from the surface opening of the annulus) may be performed to bring the top of the cement to the surface. However, the top job will only be successful if the loss of cement from the annulus can be controlled.

SUMMARY

A method of cementing a casing in a wellbore extending from an Earth's surface into a subsurface includes providing a tube having a bi-frustoconical shape defined by an upper tube part having an inverted frustoconical shape, a lower tube part having a frustoconical shape, and a waist intermediate between the upper tube part and the lower tube part. The method includes positioning the tube in an annulus formed between the casing and a wall of the wellbore from a surface opening of the annulus. The method includes urging the tube in a direction down the annulus and along the casing until the tube lands on a collar radially projecting from an outer surface of the casing into the annulus. The act of urging the tube in a direction down the annulus and along the casing may include loading an initial amount of a cement slurry into the upper tube part, wherein the tube moves down the annulus and along the casing under a weight of the cement slurry. The method may include loading an additional amount of the cement slurry into the annulus and on top of the initial amount of cement slurry until a top of the cement slurry is at a predetermined height within the annulus. Alternatively, the method may include loading an additional amount of the cement slurry into the annulus and on top of the initial amount of cement slurry until a top of the cement slurry is at or proximate the surface opening of the annulus. The method may include hardening the cement slurry to form a column of cement in a portion of the annulus above the upper tube part with the column of cement forming a seal between the wall of the wellbore and the outer surface of the casing. The method may include lowering the casing into the wellbore to form the annulus prior to positioning the tube in the annulus. The act of lowering the casing into the wellbore may include lowering the casing into a conductor section of the wellbore. The method may include installing a cement basket on the outer surface of the casing prior to lowering the casing into the wellbore. The cement basket may provide the collar on which the tube is landed.

A system for protecting a wellbore includes a casing disposed in the wellbore and separated from a wall of the wellbore by an annulus, a collar surrounding the casing and radially projecting from an outer surface of the casing into the annulus, and a cementing tool to be landed on the collar. The cementing tool includes a tube having a bi-frustoconical shape defined by an upper tube part having an inverted frustoconical shape, a lower tube part having a frustoconical shape, and a waist intermediate between the upper tube part and the lower part. The upper tube part and the lower tube part may be joined at the waist. The tube may have an asymmetric bi-frustoconical shape. The upper tube part may be sized to engage the casing and the wall of the wellbore when the cementing tool is landed on the collar. The inner diameter of the tube at the waist may be smaller than an outer diameter of the collar such that the lower tube part hangs off the collar when the cementing tool is landed on the collar. The system may include a cement basket retained on the casing with the cement basket providing the collar surrounding the casing. The casing may be disposed in a conductor section of the wellbore. The tube may be made of a metal or an alloy or an elastomeric material.

An apparatus to be landed on a collar surrounding a casing includes a tube having a bi-frustoconical shape defined by an upper tube part having an inverted frustoconical shape, a lower tube part having a frustoconical shape, and a waist intermediate between the upper tube part and the lower tube part. The tube engages an outer surface of the casing at the waist when landed on the collar. The tube may have an asymmetric bi-frustoconical shape.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
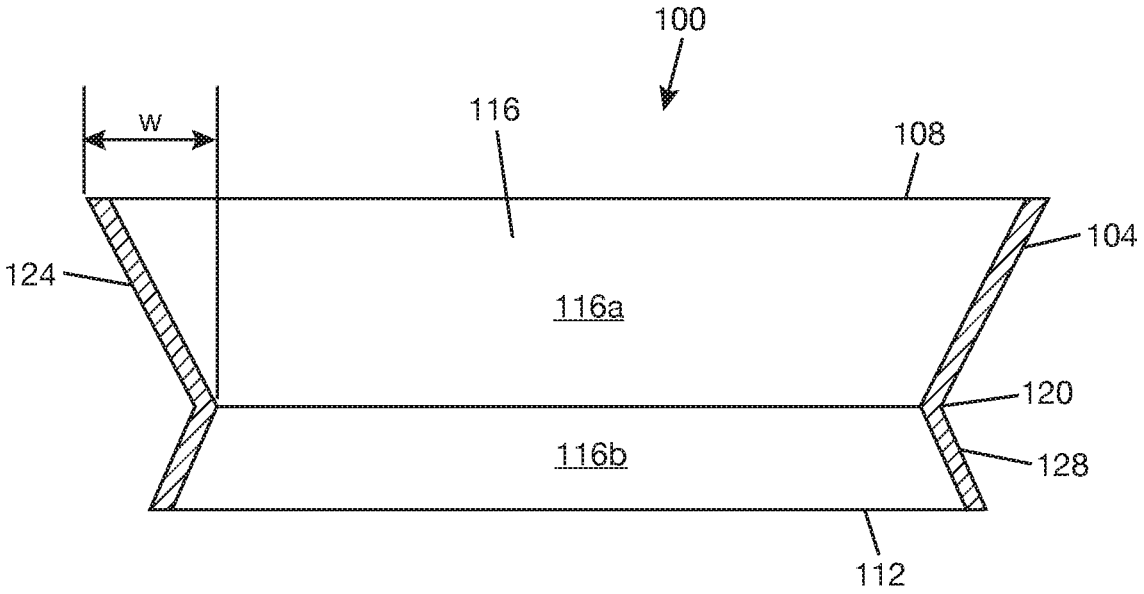
FIG. 1 is a vertical cross-sectional view of a cementing tool according to one illustrative implementation.

In this detailed description, certain specific details are set forth in order to provide a thorough understanding of various disclosed embodiments and implementations. However, one skilled in the relevant art will recognize that embodiments and implementations may be practiced without one or more of these specific details, or with other methods, components, materials, and so forth. In other instances, well known features or processes associated with cementing jobs have not been shown or described in detail to avoid unnecessarily obscuring descriptions of the embodiments and implementations. For the sake of continuity, and in the interest of conciseness, same or similar reference characters may be used for same or similar objects in multiple figures.

Figure 2:
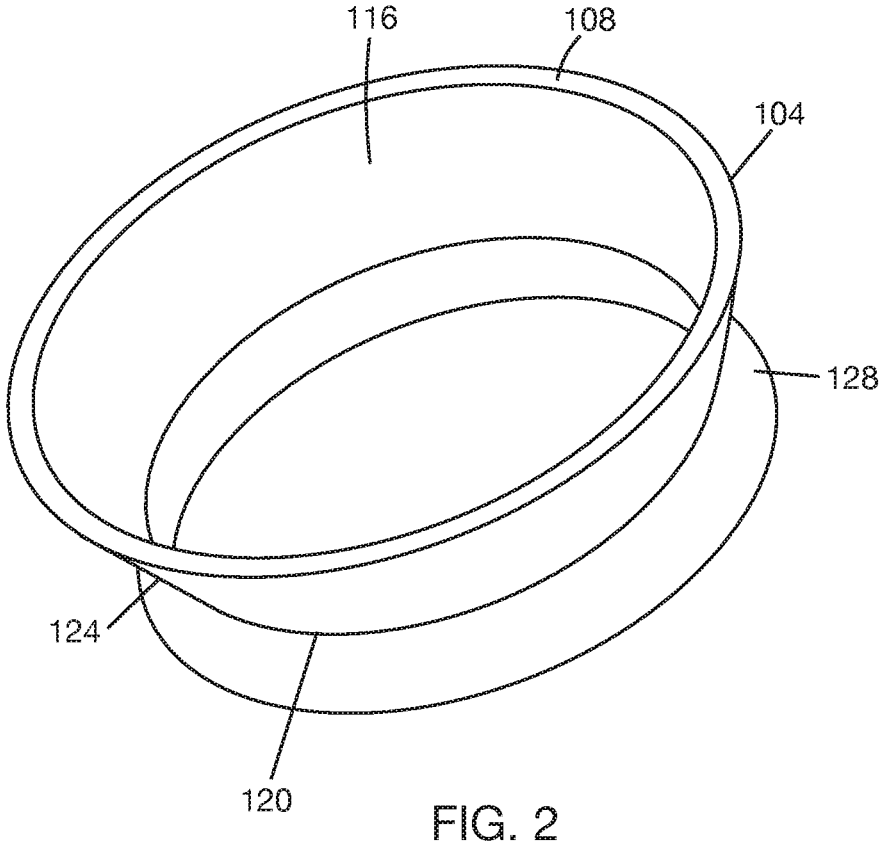
FIG. 2 is a perspective view of the cementing tool.

FIGS. 1 and 2 are different views of an exemplary cementing tool 100 that may be used to perform a cementing top job. Cementing tool 100 includes a tube 104 to be disposed around a casing in a wellbore. Tube 104 may be made of a metal, an alloy, or an elastomeric material such as nitrile rubber or carboxylated nitrile rubber. Tube 104 has a top end 108, a bottom end 112, and a bore 116 extending between the top and bottom ends 108, 112. Tube 104 has a waist 120 (narrow part) at a location intermediate between top and bottom ends 108, 112. The diameter of bore 116 is smallest at waist 120 compared to at top and bottom ends 108, 112. The diameter of bore 116 at waist 120 may be approximately the same as or slightly larger than the outer diameter of the casing to be cemented in the wellbore with cementing tool 100. Tube 104 has an upper tube part 124 above waist 120 and lower tube part 128 below waist 120. Upper tube part 124 includes an upper portion **116*a* of bore 116, and lower tube part 128 includes a lower portion 116*b* of bore 116. Upper tube part 124 has an inverted frustoconical shape with a wide diameter at top end 108 and a narrow diameter at waist 120. The diameter of upper tube part 124 may increase linearly or nonlinearly from waist 120 to top end 108. Lower tube part 128 has a frustoconical shape with a narrow diameter at waist 120 and a wide diameter at bottom end 112. The diameter of lower tube part 128 may increase linearly or nonlinearly from waist 120 to bottom end 112. In this example, tube 104** may be described as having a bi-frustoconical shape.

The outer diameter of upper tube part 124 at top end 108 may be approximately the same as or slightly larger than the diameter of the section of the wellbore in which the casing is to be cemented. In general, a radial width w of upper tube part 124 may be selected such that when cementing tool 100 is disposed in an annulus between a casing and a wall of a wellbore (in FIGS. 5-8), upper tube part 124 engages the casing at waist 120 and the wellbore at top end 108 (the radial width w is half of the outer diameter of upper tube part 124 at top end 108 less the inner diameter of upper tube part 124 at waist 120). The outer diameter of upper tube part 124 at top end 108 may be larger than the outer diameter of lower tube part 128 at bottom end 112 such that the inverted frustoconical shape formed by upper tube part 124 is larger than the frustoconical shape formed by lower tube part 128 (i.e., tube 104 has an asymmetric bi-frustoconical shape).

Figure 3:
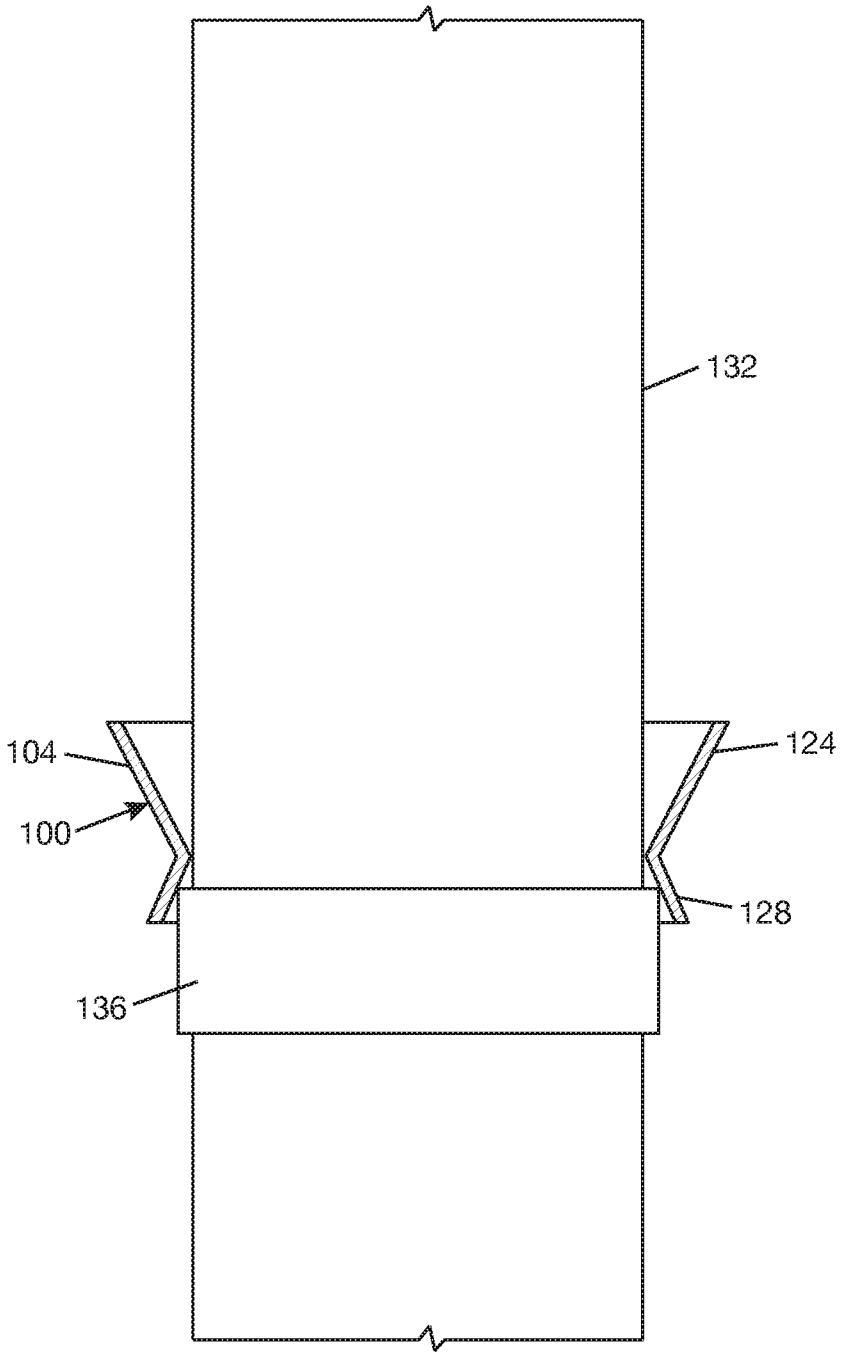
FIG. 3 is a schematic diagram showing the cementing tool surrounding a casing.

For illustrative purposes, FIG. 3 shows cementing tool 100 relative to an example casing 132. Tube 104 of cementing tool 100 has been slipped over casing 132 and surrounds casing 132. A collar 136 disposed around casing 132 acts as a stop and support for tube 104. A collar is a restraining or connecting band, ring, or pipe. Collar 136 may be provided by any suitable structure installed on casing 132. In the illustrated example, the outer diameter of collar 136 is larger than the outer diameter of casing 132 such that collar 136 projects radially from an outer surface of casing 132. In the landed position of cementing tool 100 on collar 136, lower tube part 128 engages and hangs off collar 136. In the landed position, upper tube part 124 opens upwardly and provides a receptacle to hold cement slurry. When cementing tool 100 is disposed in an annulus between a casing and a wellbore, a column of cement in the annulus can be formed on upper tube part 124. In this case, upper tube part 124 preferably has sufficient rigidity to maintain its shape while supporting the column of cement. The thickness of tube 104 is chosen depending on the selected depth of at which tube 104 will be set in an annulus such that upper tube part 124 is able to carry a column of cement above.

Figure 4:
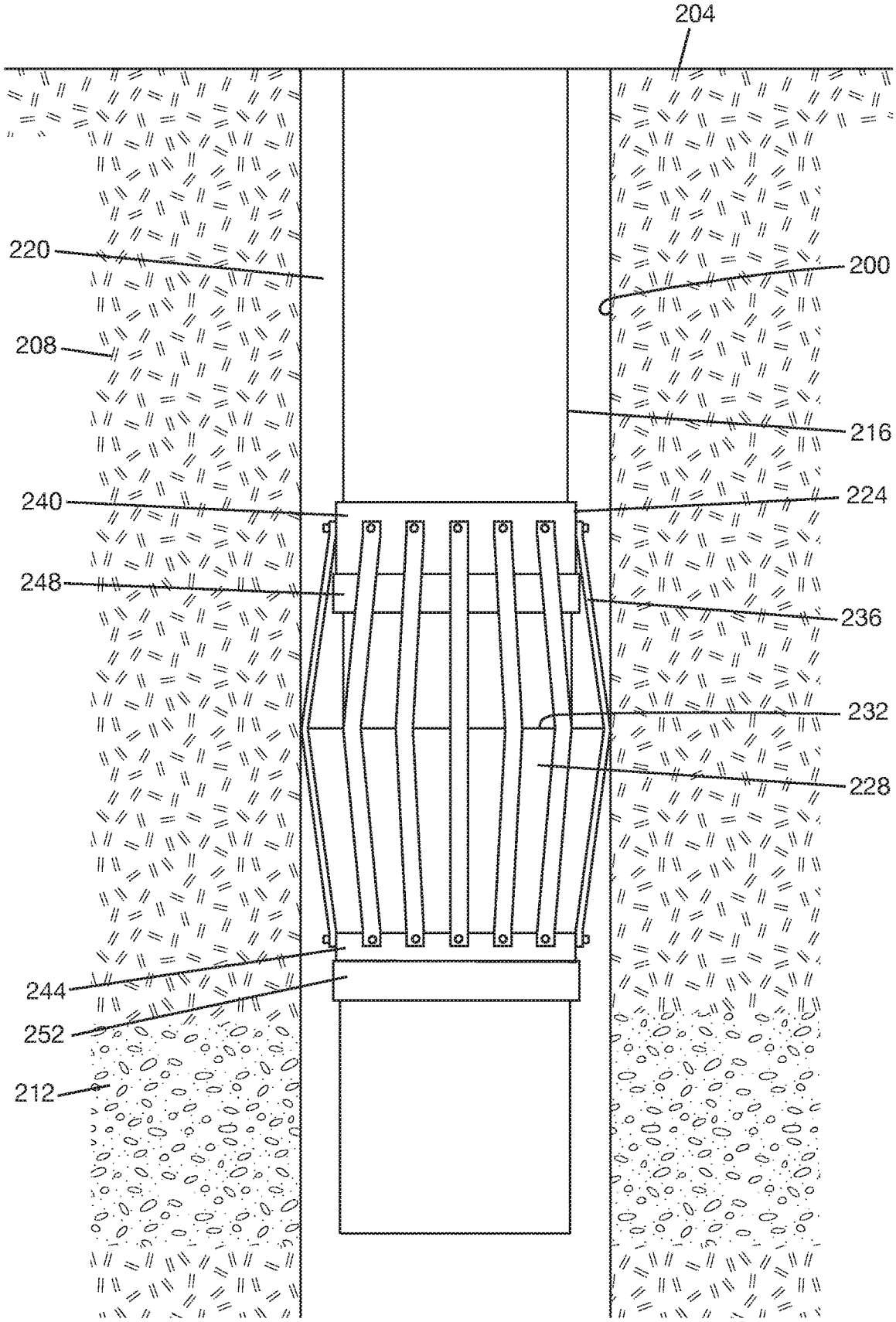
FIG. 4 is a schematic diagram showing a casing disposed in a wellbore and a cement basket retained on the casing.

FIG. 4 shows a wellbore 200 drilled below an Earth's surface 204. Wellbore 200 penetrates subsurface formation(s) 208. In one example, wellbore 200 may also penetrate a lost circulation zone 212 in the subsurface. A casing 216 has been lowered into wellbore 200, and an annulus 220 is formed between the wall of wellbore 200 and outer surface of casing 216. In one example, casing 216 is a conductor casing, and the portion of wellbore 200 in which casing 216 is disposed is the conductor section of the wellbore (i.e., the first drilled section of the wellbore). In one example a cement basket 224 may be installed on casing 216 prior to lowering casing 216 into wellbore 200. For illustrative purposes, cement basket 224 includes thin petals 228 arranged in an overlapping pattern to form a basket 232. Overlapping petals 228 are disposed within a reinforcing structure formed by flexible ribs 236 that are attached to spaced apart collars 240, 244. Cement basket 224 is retained on casing 216 by fixed collars 248, 252 on casing 216. Overlapping petals 228 spread to expand flexible ribs 236 of cement basket 224 into annulus 220 and against the wall of wellbore 200. In this case, cement basket 224 may act as a centralizer for casing 216. Cement basket 224 also provides collar 240 on which cementing tool (100 in FIGS. 1 and 2) may be landed. In the illustrated example, collar 240 of cement basket 224 sits on fixed collar 248 on casing 216. In the illustrated example, cement basket 224 is set above lost circulation zone 212.

Figure 5:
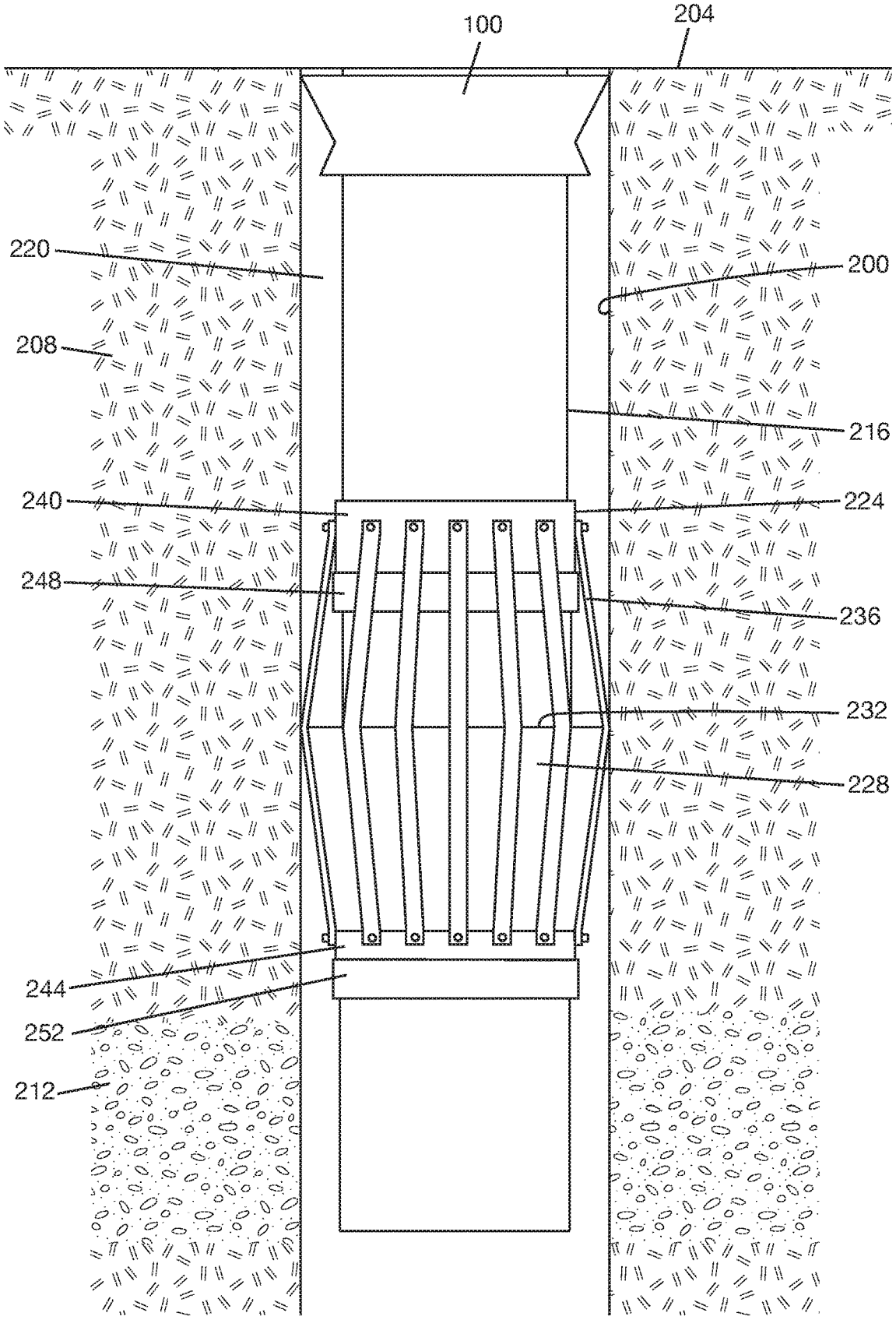
FIG. 5 is a schematic diagram showing the cementing tool positioned in an annulus formed between the casing and the wellbore.
Figure 6:
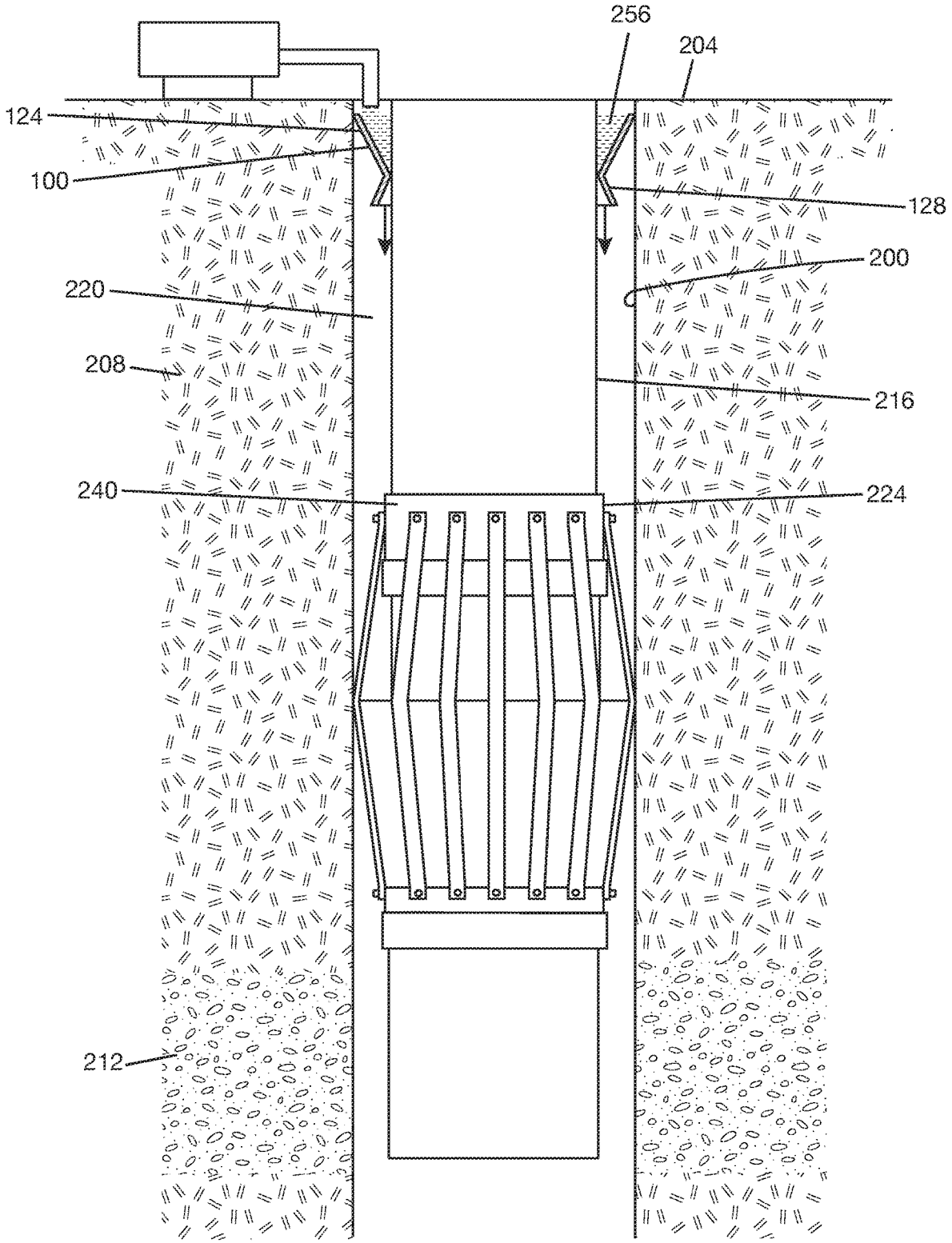
FIG. 6 is a schematic diagram showing the cementing tool filled with a cement slurry that pushes the cementing tool in a downward direction towards the cement basket.
Figure 7:
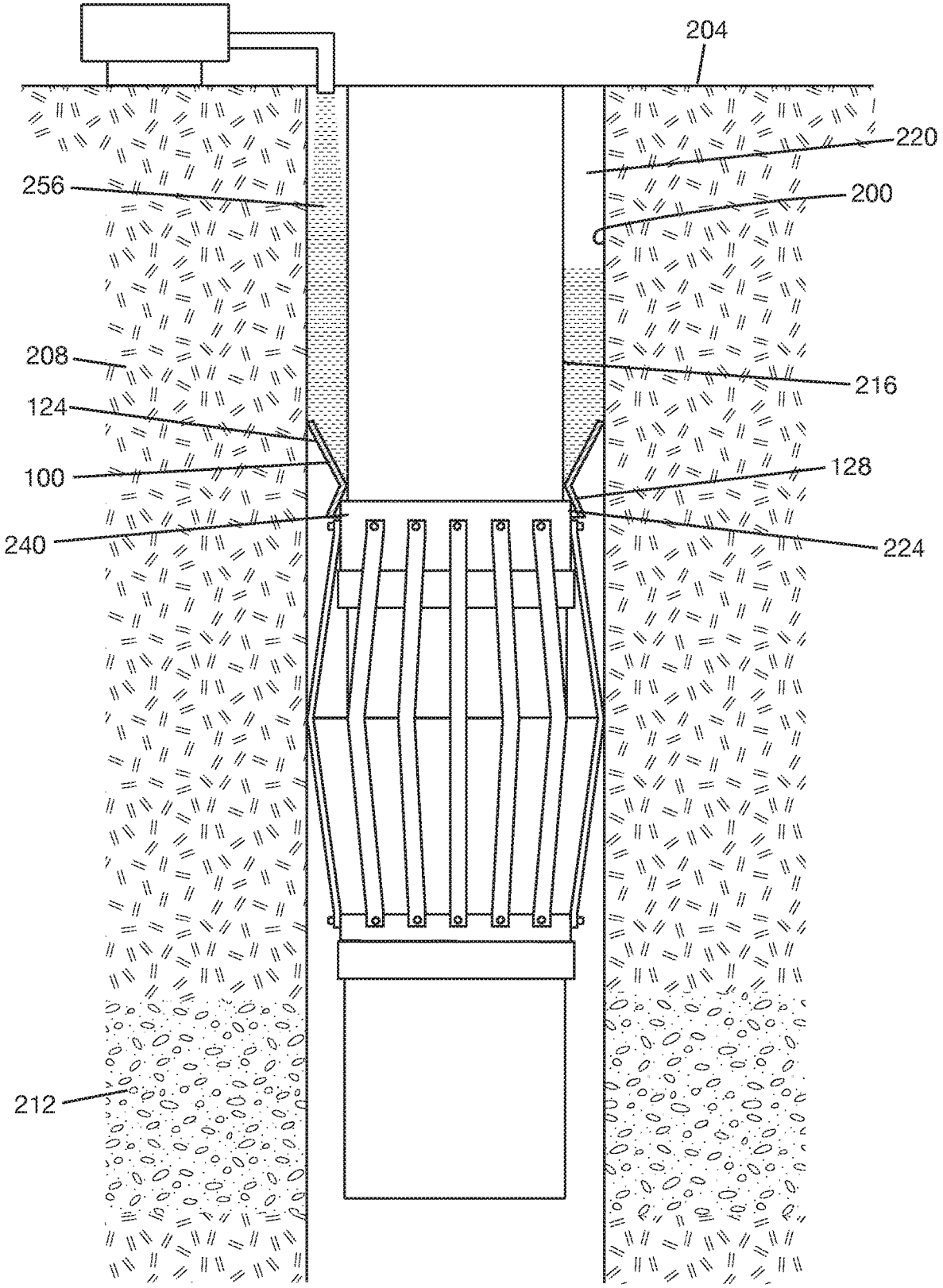
FIG. 7 is a schematic diagram showing the cementing tool after landing on the cement basket with cement slurry partially filling the annulus above the cementing tool.

A method of cementing a casing to a wall of a wellbore may generally include pumping cement slurry through the casing into the wellbore, where the cement slurry should then rise up an annulus between the casing and the wellbore wall. If cement loss to a lost circulation zone is observed, the next action may be a cementing top job. FIGS. 5-8 illustrate a top job using cementing tool 100. In FIG. 5, cementing tool 100 is slipped over casing 216 at surface 204 and positioned proximate a surface opening of annulus 220 (the surface opening of annulus 220 is the end of annulus 220 at surface 204). In this position, cementing tool 100, engages an outer surface of casing 216 and the wall of wellbore 200 by friction. Cementing tool 100 is also free to move down annulus 220 and along casing 216 under the influence of a downward force that overcomes the friction. In FIG. 6, cement slurry 256 is loaded into upper tube part 124 of cementing tool 100 to apply the downward force to cementing tool 100. Cement slurry 256 can be loaded by pouring or pumping the cement slurry into upper tube part 124 (or the space between upper tube part 124 and casing 216). The weight of cement slurry 256 in upper tube part 124 will push cementing tool 100 down and along casing 216 until cementing tool 100 (lower tube part 128) lands on upper collar 240 of cement basket 224 as shown in FIG. 7 (it should be noted that cementing tool 100 may land on a collar provided by structures other than a cement basket). Any suitable cement composition may be used to prepare the cement slurry.

Figure 8:
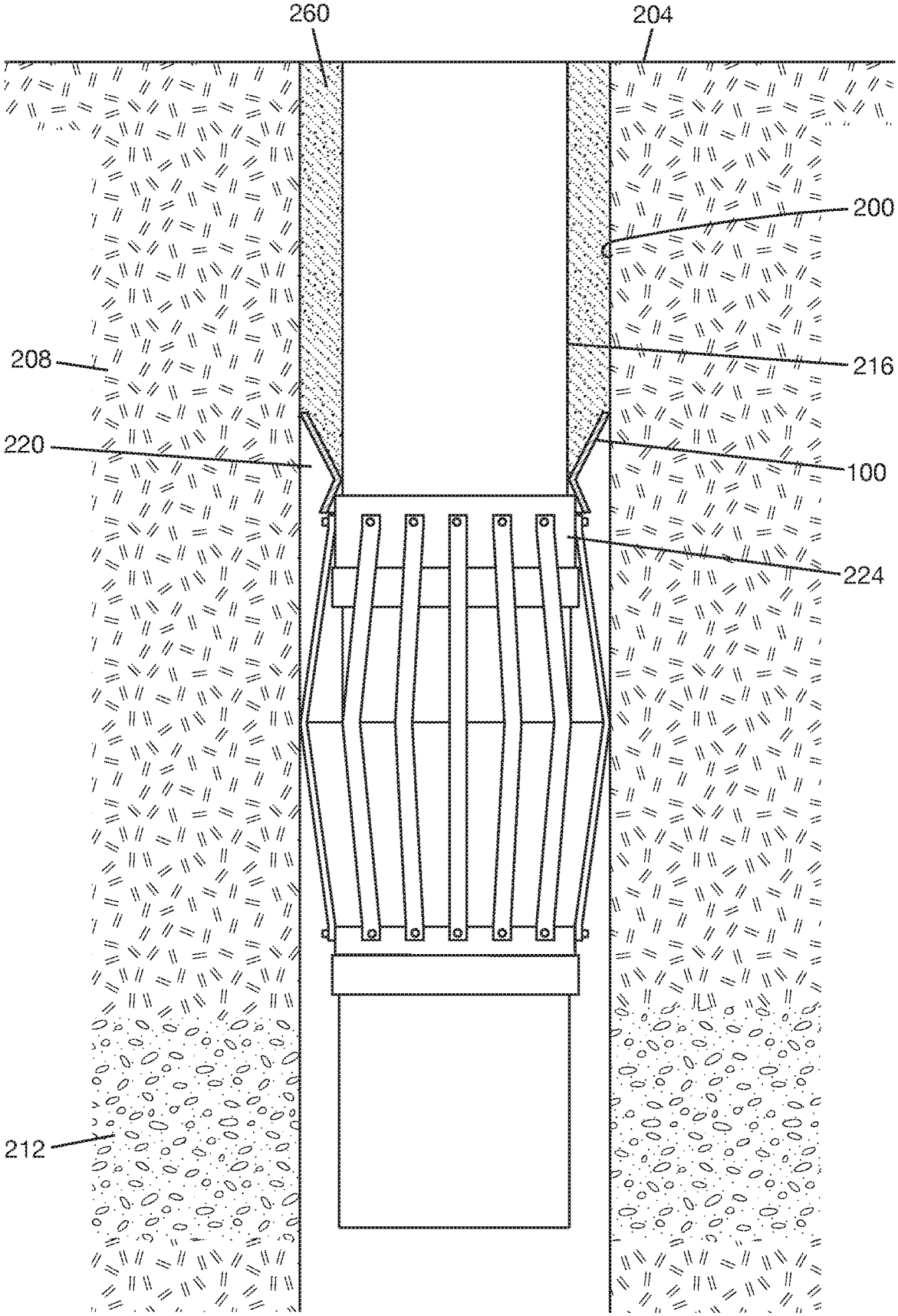
FIG. 8 is a schematic diagram showing a column of cement in a portion of the annulus above the cementing tool.

After upper tube part 124 is filled with cement slurry, additional cement slurry 256 can be loaded into the portion of annulus 220 above upper tube part 124, as shown in FIG. 7. This additional loading of cement slurry 256 can occur as cementing tool 100 moves down casing 216 towards cement basket 224. This additional loading of cement slurry 256 can also occur after cementing tool 100 has landed on collar 240. Additional loading of cement slurry 256 can continue until a top of the cement slurry is at a desired height in annulus 220. In one example, this desired height is at surface 204. After annulus 220 has been filled with cement slurry to the desired height, the cement slurry can be allowed to harden. FIG. 8 shows a column of cement 260 (hardened cement) formed in a portion of annulus 220 extending from cementing tool 100 to surface 204. Cement 260 forms a seal between casing 216 and wellbore 200. Cementing tool 100 remains in place in annulus 220 after the cementing job has been completed and isolates the portion of annulus 220 above cementing tool 100 from the remainder of wellbore 200 (and from the lost circulation zone 212).

Although specific embodiments, implementations, and examples have been described for illustrative purposes, various equivalent modifications can be made without departing from the spirit and scope of the disclosure, as will be recognized by those skilled in the relevant art. The teachings provided herein can be applied to other cementing scenarios besides the exemplary casing to wellbore cementing generally described above.

What is claimed is:

1. A method of cementing a casing in a wellbore extending from an Earth's surface into a subsurface, the method comprising:

providing a tube having a bi-frustoconical shape defined by an upper tube part having an inverted frustoconical shape, a lower tube part having a frustoconical shape, and a waist intermediate between the upper tube part and the lower tube part;

forming an annulus between the casing and a wall of the wellbore by positioning the casing in the wellbore;

positioning, in a movable position, the tube around the casing and in the annulus from a surface opening of the annulus;

urging the tube in a direction down the annulus and along the casing using a weight of a cement slurry loaded into the upper tube part; and landing the tube on a collar radially projecting from an outer surface of the casing into the annulus.

2. The method of claim 1, further comprising loading an additional amount of the cement slurry into the annulus and on top of the initial amount of cement slurry until a top of the cement slurry is at a predetermined height within the annulus.

3. The method of claim 2, further comprising hardening the cement slurry to form a column of cement in a portion of the annulus above the upper tube part, the column of cement forming a seal between the wall of the wellbore and the outer surface of the casing.

4. The method of claim 1, further comprising loading an additional amount of the cement slurry into the annulus and on top of the initial amount of cement slurry until a top of the cement slurry is at or proximate the surface opening of the annulus.

5. The method of claim 1, further comprising lowering the casing into the wellbore to form the annulus prior to positioning the tube in the annulus.

6. The method of claim 5, wherein lowering the casing into the wellbore comprises lowering the casing into a conductor section of the wellbore.

7. The method of claim 5, further comprising installing a cement basket on the outer surface of the casing prior to lowering the casing into the wellbore, wherein the cement basket provides the collar.

8. The method of claim 7, wherein lowering the casing into the wellbore comprises positioning the cement basket above a lost circulation zone in the subsurface.

9. A system for protecting a wellbore, the system comprising:

a casing disposed in the wellbore and separated from a wall of the wellbore by an annulus;

a collar surrounding the casing and radially projecting from an outer surface of the casing into the annulus;

a cementing tool, movably positioned in the annulus and around the casing, comprising a tube having a bi-frustoconical shape defined by an upper tube part having an inverted frustoconical shape, a lower tube part having a frustoconical shape, and a waist intermediate between the upper tube part and the lower part;

a supply of cement slurry in fluid communication with the upper tube part of the cementing tool; and a pump configured to pump the cement slurry from the supply of cement slurry into the upper tube part of the cementing tool, wherein, when the cement slurry is pumped into the upper tube part, the cement slurry adds weight to the cementing tool and urges the cementing tool along the casing to land on the collar.

10. The system of claim 9, wherein the upper tube part and the lower tube part are joined at the waist.

11. The system of claim 9, wherein the tube has an asymmetric bi-frustoconical shape.

12. The system of claim 11, wherein the upper tube part is sized to engage the casing and the wall of the wellbore when the cementing tool is landed on the collar.

13. The system of claim 9, wherein an inner diameter of the tube at the waist is smaller than an outer diameter of the collar such that the lower tube part hangs off the collar when the cementing tool is landed on the collar.

14. The system of claim 9, further comprising a cement basket retained on the casing, wherein the cement basket provides the collar surrounding the casing.

15. The system of claim 9, wherein the casing is disposed in a conductor section of the wellbore.

16. The system of claim 9, wherein the tube is made of a metal or an alloy.

17. The system of claim 9, wherein the tube is made of an elastomeric material.

18. An apparatus comprising:

a tube having a bi-frustoconical shape, the tube comprising:

an upper tube part having an inverted frustoconical shape configured to receive a cement slurry;

a lower tube part having a frustoconical shape and configured to land on a collar surrounding a casing; and a waist intermediate between the upper tube part and the lower tube part, wherein the tube is movably positioned around the casing, the cement slurry provides a weight to urge the tube down the casing, and the tube engages an outer surface of the casing at the waist when landed on the collar.

19. The apparatus of claim 18, wherein the tube has an asymmetric bi-frustoconical shape.

* * * * *